US009859030B2

(12) United States Patent
Suh et al.

(10) Patent No.: US 9,859,030 B2
(45) **Date of Patent: *Jan. 2, 2018**

(54) METHOD OF MANUFACTURING GRAPHENE-COATED COMPOSITE POWDER

(71) Applicant: RESEARCH & BUSINESS FOUNDATION SUNGKYUNKWAN UNIVERSITY, Suwon-si (KR)

(72) Inventors: Sujeong Suh, Suwon-si (KR); Youngil Song, Suwon-si (KR); Jungwoo Lee, Suwon-si (KR)

(73) Assignee: Research & Business Foundation Sungkyunkwan University, Suwon-si (KR)

( * ) Notice: Subject to any disclaimer, the term of this patent is extended or adjusted under 35 U.S.C. 154(b) by 95 days.

This patent is subject to a terminal disclaimer.

(21) Appl. No.: 14/668,153

(22) Filed: Mar. 25, 2015

(65) Prior Publication Data

US 2015/0287491 A1 Oct. 8, 2015

(30) Foreign Application Priority Data

Apr. 8, 2014 (KR) ..... 10-2014-0041761

(51) Int. Cl.

| | |
|---|---|
| ***H01B 1/02*** | (2006.01) |
| ***H01B 1/04*** | (2006.01) |
| ***B22F 9/14*** | (2006.01) |
| ***B22F 1/02*** | (2006.01) |

(52) U.S. Cl.

CPC ..... *H01B 1/02* (2013.01); *B22F 1/02* (2013.01); *B22F 9/14* (2013.01); *H01B 1/04* (2013.01)

(58) Field of Classification Search

CPC . C25D 15/00; C25D 3/38; C25D 3/46; C25D 3/12; C25D 3/54; C25D 3/48; C25D 3/20; B05B 7/0006

USPC ..... 428/403; 205/50, 322, 316, 320, 323; 427/122

See application file for complete search history.

(56) References Cited

U.S. PATENT DOCUMENTS

| | | | | |
|---|---|---|---|---|
| 8,372,734 | B2 * | 2/2013 | Van Duren | B22F 1/0055 427/64 |
| 8,545,652 | B1 * | 10/2013 | Biberger | B32B 5/16 156/274.4 |
| 8,809,678 | B2 * | 8/2014 | Sager | B22F 1/0018 136/262 |
| 8,821,786 | B1 * | 9/2014 | Biberger | B01J 23/42 419/19 |
| 8,877,357 | B1 * | 11/2014 | Biberger | B01J 23/42 156/62.2 |
| 9,309,131 | B2 * | 4/2016 | Kaledin | B01J 20/08 |
| 2014/0001123 | A1 * | 1/2014 | Kaledin | B01J 20/08 210/660 |
| 2016/0024681 | A1 * | 1/2016 | Suh | C25D 15/00 205/50 |
| 2016/0318099 | A1 * | 11/2016 | Seo | B22F 1/02 |
| 2017/0021417 | A1 * | 1/2017 | Martin | B22F 3/1028 |
| 2017/0183234 | A1 * | 6/2017 | Wada | C01B 31/06 |

FOREIGN PATENT DOCUMENTS

| | | |
|---|---|---|
| KR | 10-2009-0092619 A | 9/2009 |
| KR | 10-2011-0068647 A | 6/2011 |
| KR | 10-1365716 B1 | 2/2014 |

* cited by examiner

*Primary Examiner* — Douglas McGinty
(74) *Attorney, Agent, or Firm* — NSIP Law

(57) ABSTRACT

A method of manufacturing a composite powder using wire explosion and a composite powder prepared by such a method are provided. The method of manufacturing a composite powder may involve coating a metal wire with a carbon-based material, and performing wire explosion on the metal wire coated with the carbon-based material in a solution. The prepared composite powder may include a metal core and a multilayer graphene film that coats a surface of the metal core.

17 Claims, 4 Drawing Sheets

[FIG. 1]
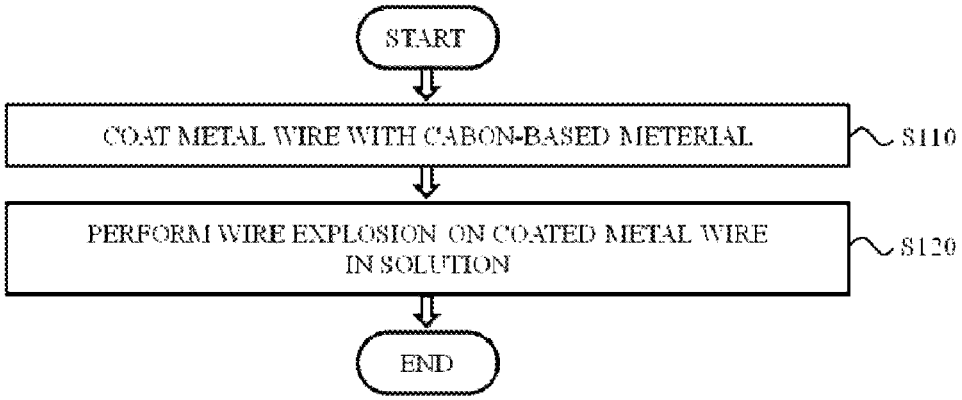
[FIG. 2A]
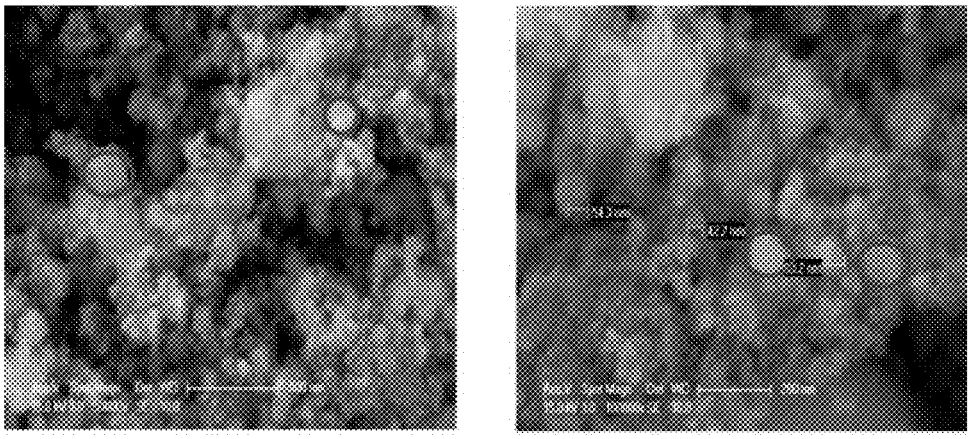

[FIG. 2B]
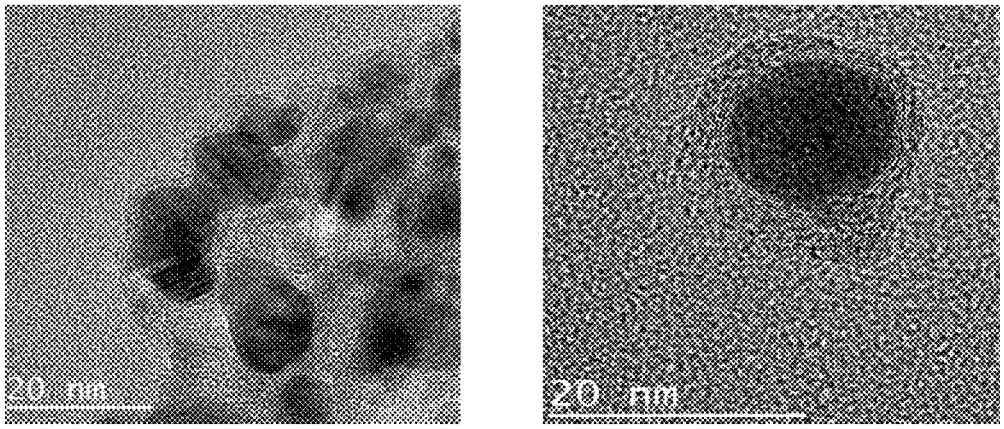
[FIG. 3]
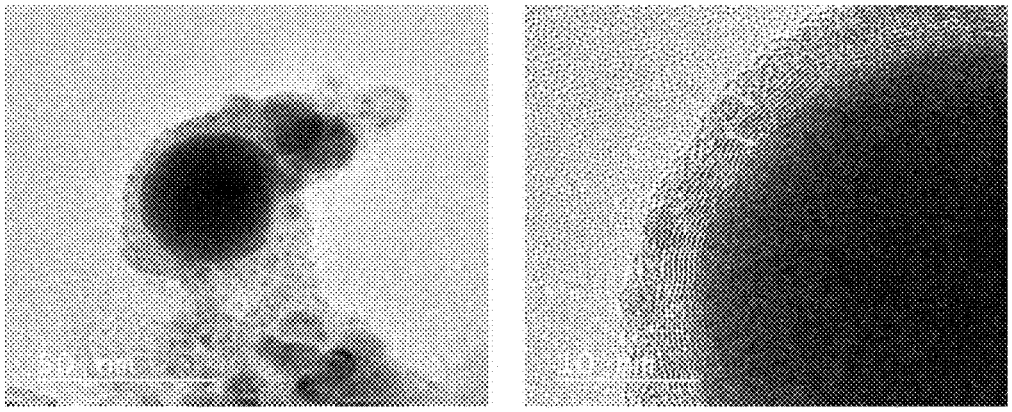

[FIG. 4]
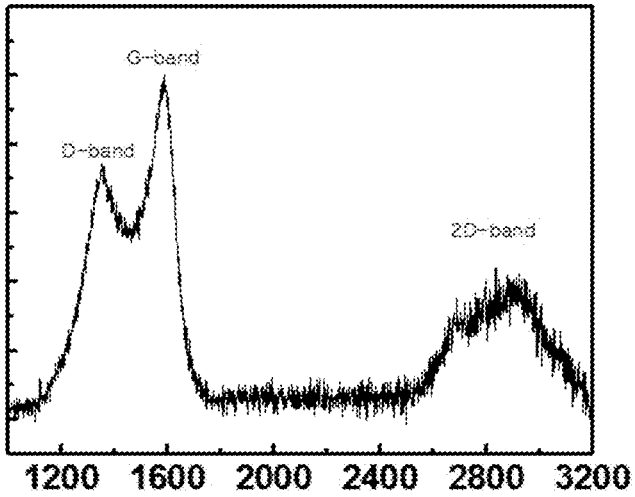
[FIG. 5A]
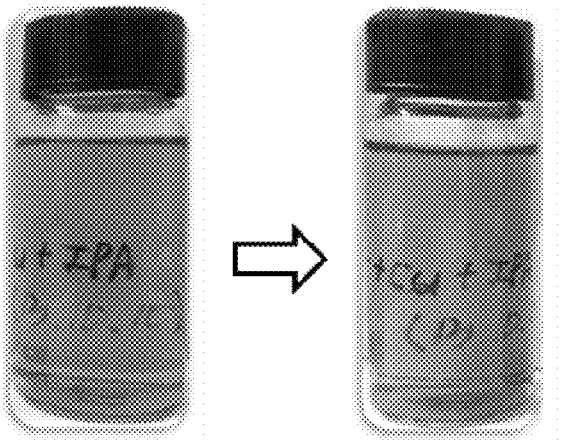

[FIG. 5B]
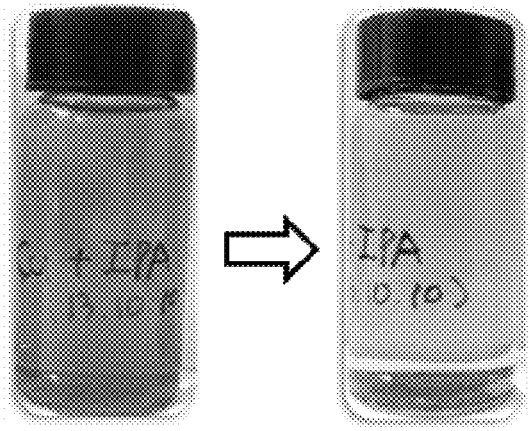
[FIG. 6]
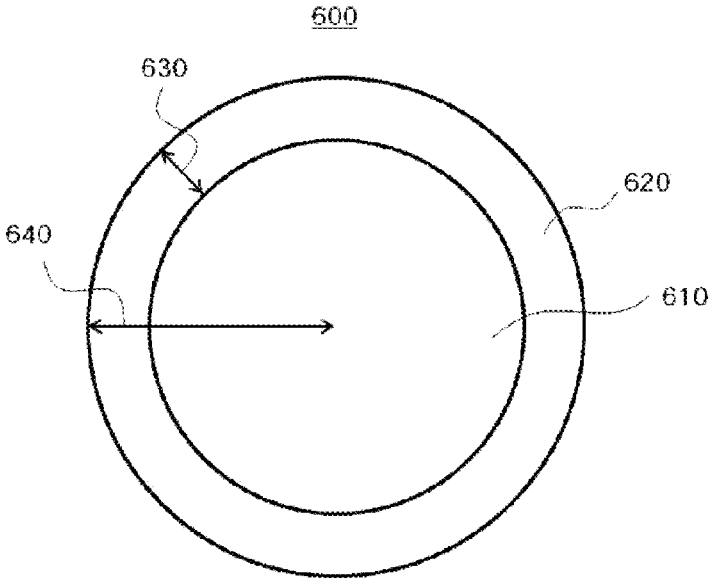

METHOD OF MANUFACTURING GRAPHENE-COATED COMPOSITE POWDER

CROSS-REFERENCE TO RELATED APPLICATION

This application claims the benefit under 35 U.S.C. §119 (a) of Korean Patent Application No. 10-2014-0041761 filed on Apr. 8, 2014, in the Korean Intellectual Property Office, the entire disclosure of which is incorporated herein by reference for all purposes.

BACKGROUND

1. Field

The following description relates to a method of manufacturing composite powder composed of metal particles and multilayer graphene films coated on surfaces thereof using a wire explosion technique, and a composite powder obtained by such a method.

2. Description of Related Art

Research on electrical wire explosion technique is progressing as one of methods for producing metal nanoparticles. A method of using wire explosion techniques for manufacturing metal nanoparticles is evaluated as an economical and environment-friendly method, in comparison to other methods such as the technique of pulverizing a metal using instant electric energy.

However, when a carbon-coated metal powder is prepared using wire explosion, a carbon-coated layer was only formed on a part of a surface of the formed powder. When a carbon-coated layer is formed only on a part of the surface of the prepared powder, the metal particles are oxidized and are not suitable storage for an extended length of time due to poor dispersibility in a solution.

Accordingly, many limitations exist in preparing metal powders by wire explosion.

SUMMARY

The present disclosure provides a method of manufacturing composite powder having metal particles coated with a multilayer graphene film by wire explosion in a solution using a metal wire on which a carbon-based material is coated.

In one aspect, there is provided a method of manufacturing composite powder, the method involving coating a metal wire with a carbon-based material, and performing a wire explosion on the metal wire coated with the carbon-based material in a solution.

The metal wire may be composed of copper, nickel, aluminum, iron, gold, silver, stainless steel, tin, zinc, titanium, tantalum, an alloy thereof, or a mixture thereof.

The carbon-based material may include graphene or graphite.

The carbon-based material may include graphene or graphite with a thickness of 1 to 20 carbon atom layers.

The carbon-based material may include graphene or graphite with a thickness of 1 to 10 carbon atom layers.

The coating of the metal wire with the carbon-based material may involve synthesizing the graphene on a surface of the metal wire, or transferring the synthesized graphene on the surface of the metal wire.

The solution may be an organic solution, an inorganic solution, or an organic and inorganic solution mixture.

The solution may include at least one selected from the group consisting of isopropyl alcohol, acetone, ethanol, methanol, a carbon compound solvent, a carbon-containing glycol, glycerine, triethanolamine or methylene chloride, deionized water, distilled water, hydrogen peroxide, a metal compound solvent, and a combination thereof.

The metal powder obtained by the wire explosion may include composite nanoparticles each comprising a metal core coated with a multilayer graphene sheet having a thickness of approximately 1 to 20 carbon atom layers.

In another general aspect, a composite powder includes a metal particle coated with a carbon-coated layer, the carbon-coated layer comprising a multilayer graphene film used to coat a surface of the metal particle and having electric conductivity, and the multilayer graphene film has a thickness of 1 to 20 carbon atom layers.

The metal particle may be composed of copper, nickel, aluminum, iron, gold, silver, stainless steel, tin, zinc, titanium, tantalum, or an alloy or mixture thereof.

The carbon-coated layer may comprise 10 wt % or less of an amorphous carbon film based on a total weight of the carbon-coated layer.

In another general aspect, there is provided a method of preparing a composition of composite powder, the method involving obtaining a metal wire coated with a carbon-based material, and performing a wire explosion on the metal wire coated with the carbon-based material in a solution.

The solution may include at least one selected from the group consisting of isopropyl alcohol, acetone, ethanol, methanol, a carbon compound solvent, a carbon-containing glycol, glycerine, triethanolamine or methylene chloride, deionized water, distilled water, hydrogen peroxide, a metal compound solvent, and a combination thereof.

The performing of the wire explosion may involve forming a plasma in the solution, and causing a condensation of nanoparticles comprising a metal core covered with a carbon-coated layer.

The metal wire coated with the carbon-based material may be obtained by forming a film comprising 2 to 5 layers of graphene sheets over the metal wire.

The carbon-coated layer may include a multilayer graphene film having a thickness of 1 to 20 graphene sheets.

Other features and aspects may be apparent from the following detailed description, the drawings, and the claims.

BRIEF DESCRIPTION OF THE DRAWINGS

FIG. 1 is a flowchart for describing an example of a method of manufacturing a composite powder according to the present disclosure.

FIG. 2A shows scanning electron microscope (SEM) images of composite powder particles prepared according to the example described with reference to FIG. 1.

FIG. 2B shows transmission electron microscope (TEM) images of composite powder particles prepared according to the example described with reference to FIG. 1.

FIG. 3 shows TEM images of composite powder particles prepared according to a comparative example.

FIG. 4 is a graph showing analyzing results obtained using Raman spectroscopy for composite powder particles prepared according to the example described with reference to FIG. 1.

FIGS. 5A and 5B are images for describing dispersion stability of composite powder particles prepared according to the example described with reference to FIG. 1 and copper powders prepared according to a comparative example.

FIG. 6 is a schematic diagram illustrating an example of a nano-particle in a powder manufactured by the method described with reference to FIG. 1.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses and/or methods described herein will be suggested to those of ordinary skill in the art. Also, descriptions of well-known functions and constructions may be omitted for increased clarity and conciseness.

Terms such as "first", "second" and the like may be used to explain various components, but the components should not be limited by the terms. Such a term is only used to distinguish one component from another one. For example, a first component may be called as a second component, and similarly a second component may also be called as a first component without departing from the claim of the present disclosure.

The terms used herein are used to only explain a specific example, not to limit the present disclosure. A singular expression includes a plural expression, unless clearly defined in a context otherwise. The term "include" or "have" used herein refers that a characteristic or a component disclosed in the specification is present, and does not refer that other characteristics or components are not present or added.

Unless defined otherwise, all terms used herein including technological or scientific terms have the same meaning as generally understood by those of ordinary skill in the art. It should be understood that the same terms as defined in the dictionary generally used have meanings corresponding to those in the context of a related art, and unless clearly defined in the present disclosure, they are not understood as ideal or excessively formal meanings.

The "metal" used herein is defined to include a metal alloy, a metal mixture, etc. as well as a pure metal.

FIG. 1 is a flow chart for describing a method of manufacturing composite powder according to an example of the present disclosure.

Referring to FIG. 1, the method of manufacturing composite powder according to an example of the present disclosure includes coating a metal wire with a carbon-based material (S110); and performing wire explosion on the carbon-based material-coated metal wire in a solution (S120).

As the metal wire, a wire composed of Cu, Ni, Al, Fe, Au, Ag, SUS, Sn, Zn, Ti, Ta, or an alloy or mixture thereof may be used. A diameter and an exploded length of the metal wire may be suitably adjusted in consideration of a size of the prepared composite powder particles. For example, to manufacture nano-scale composite powder particles, the diameter of the metal wire may be approximately 0.01 to 1 mm, and the exploded length of the metal wire may be approximately 1 to 150 mm. However, the present disclosure is not limited thereto; for instance, in another example, the diameter of the metal wire may be approximately 0.02 to 0.8 mm or 0.1 mm to 0.5 mm, and the exploded length of the metal wire may be approximately 2 to 100 mm, 3 to 50 mm, and the like. The metal wire may have a circular diameter, and an overall cylindrical shape. However, the present disclosure is not limited thereto.

As the carbon-based material coating the metal wire, graphene or graphite may be used. In one embodiment, as the carbon-based material, graphene may be used. To obtain a metal wire that is coated with graphene, the graphene-coated layer of the metal wire may be formed by directly synthesizing the graphene on a surface of a metal wire, or by transferring the synthesized graphene onto a surface of the metal wire. The graphene-coated layer may include a single carbon atom layer or a plurality of carbon atom layers. As an embodiment, the graphene-coated layer may include approximately 1 to 20 carbon atom layers, and preferably approximately 1 to 10 carbon atom layers.

The wire explosion of the metal wire may be performed in a solution. For example, the wire explosion of the metal wire may be performed in an organic or inorganic solvent. In one embodiment, the wire explosion of the metal wire may be performed in at least one solution selected from the group consisting of isopropyl alcohol, acetone, ethanol, methanol, a carbon compound solvent, a carbon-containing glycol, glycerine, triethanolamine or methylene chloride, deionized water, distilled water, hydrogen peroxide, a metal compound solvent, or a combination thereof.

The wire explosion may performed by discharging a high voltage stored in a capacitor, for example, alternative and direct voltages of approximately 200 V to 50 kV, to the metal wire. During the wire explosion, the exploded metal wire is changed into a plasma state, and rapidly cooled due to collision with the solution and condensed, thereby forming metal powder particles. During metal pulverization of the metal wire caused by the wire explosion, metal atoms in the metal wire may be rapidly cooled in a solution and condensed in a stable spherical shape, carbon atoms in the carbon-based material coated layer may be exploded and then recombined on a surface of the metal powder, thereby forming a multilayer graphene film coating the metal powder particles. For example, in the event that the wire explosion is performed in an organic solvent, after a bond between molecules is broken, carbon atoms in the organic solvent may also be recombined on a surface of the metal powder along with the carbon atoms in the carbon-based material-coated layer, thereby forming the multilayer graphene film.

In one embodiment, in the event that a metal wire coated with graphene including 5 layers or less of carbon atom layers is subjected to wire explosion in a solution to prepare a composite powder, multilayer graphene-coated metal particles formed of approximately 2 to 20 carbon atoms layers may be prepared.

Hereinafter, examples of the present disclosure will be described below. The following examples are merely examples of the present disclosure, and the scope of the present disclosure is not limited to the following examples.

EXAMPLE

A copper wire coated with graphene including approximately 5 or less of carbon atom layers was subjected to wire explosion in an isopropyl alcohol (IPA) solution, thereby manufacturing a composite powder.

Comparative Example

A pure copper wire that was not coated with a carbon-based material was subjected to wire explosion in an IPA solution, thereby manufacturing a composite powder. A diameter and explosion length of the copper wire used in Comparative Example were the same as those of the graphene-coated copper wire used in the example of FIG. 1, and a voltage applied to the copper wire was also the same as that applied to the graphene-coated copper wire used in Example.

Experimental Example

FIG. 2A shows scanning electron microscope (SEM) images of composite powder particles prepared according to the example of FIG. 1, FIG. 2B are transmission electron microscope (TEM) images of composite powder particles prepared according to the example of FIG. 1, and FIG. 3 are TEM images of composite powder particles prepared according to Comparative Example.

According to FIGS. 2A and 2B, it can be confirmed that when the composite powder particles were prepared according to the example of FIG. 1, spherical composite powder particles having a size of several tens to several hundreds of nanometers were prepared. Particularly, it can be confirmed that when the composite powder particles were prepared according to the example of FIG. 1, the composite powder particles having a relatively uniform size were formed, a carbon-coated layer having a relatively uniform thickness was formed on all of a plurality of particles. Particularly, it can be confirmed that the carbon-coated layer was a multilayer graphene film formed of approximately 2 to 20 carbon atom layers, and hardly had an amorphous carbon film thereon. That is, in the carbon-coated layer, the amorphous carbon film was approximately 10% or less based on a total weight of the carbon-coated layer.

In comparison to FIGS. 2A and 2B, referring to FIG. 3, it can be confirmed that when the composite powder particles was prepared according to comparative example, a carbon-coated layer was formed thereon, but the composite powder particles had relatively non-uniform sizes, and the amorphous carbon film was further formed on the surface in addition to the multilayer graphene film.

Accordingly, when the composite powder particles were formed according to Example of the present disclosure, the composite powder particles could have a relatively uniform size, and could have crystalline multilayer graphene-coated layer formed on a most of its surface. Meanwhile, since the composite powder particles prepared according to Example of the present disclosure hardly had an amorphous carbon film on its surface, it is considered that the powder had excellent electric conductivity and dispersibility in the solution.

FIG. 4 is a graph showing an analysis result for the composite powder prepared according to Example using Raman spectroscopy.

Referring to FIG. 4, it can be confirmed that a G peak contributing to electric conductivity was larger than a D peak, and a 2D peak was also shown. According to such a result, it is determined that surfaces of copper powder particles were coated with a multilayer graphene film having electric conductivity.

FIGS. 5A and 5B are images for describing the dispersion stability of composite powder particles prepared according to the example of FIG. 1 and copper powder particles prepared according to Comparative Example. In FIGS. 5A and 5B, the images on the left side are taken right after the wire explosion, and the images on the right side are taken at 60 days after the wire explosion.

Referring to FIGS. 5A and 5B, it can be confirmed that the composite powder particles prepared according to the example of FIG. 1 were still uniformly dispersed in a solution at 60 days after the wire explosion. Contrarily, when copper powder particles were prepared according to Comparative Example, copper particles were uniformly dispersed in a solution right after the wire explosion, but precipitated at 60 days after the wire explosion, and thus it can be confirmed that a solution became clear.

Therefore, when the composite powder particles are prepared according to the example of FIG. 1 of the present disclosure, composite powder particles having considerably enhanced dispersion stability in a solution may be prepared.

FIG. 6 is a schematic diagram illustrating an example of a nano-particle in a powder manufactured by the method described with reference to FIG. 1.

Referring to FIG. 6, the powder manufactured by the method described with reference to FIG. 1 may include composite nano-particles each having a metal core 610 and a carbon-coated layer 620 including a multilayer graphene film, as illustrated in FIG. 2B, for example. The carbon-coated layer 620 covers all direction of the metal core 610, which may be a metal particle having a spherical or substantially spherical shape. However, the shape of the metal core 610 is not limited thereto. The metal core 610 may be composed of copper, nickel, aluminum, iron, gold, silver, stainless steel, tin, zinc, titanium, tantalum, an alloy thereof, or a mixture thereof, for example.

The carbon-coated layer 620 may have a thickness 630 of approximately 1 nm to 10 nm, 1 nm to 8 nm or 2 nm to 4 nm, for example. The thickness 630 may correspond to the thickness of approximately 1 to 20 graphene sheets, 2 to 15 graphene sheets, or 4 to 8 graphene sheets. However, the present disclosure is not limited thereto; the thickness 630 of the carbon-coated layer 620 may be adjusted by adjusting the thickness of the metal wire used to produce the powder and the thickness of graphene coating on the metal wire.

The shape of the nano-particle 600 may be spherical or substantially spherical. The nanoparticles may be substantially uniform size. For example, a radius 640 of the particles may range between approximately 5 nm to 40 nm, 6 nm to 30 nm, or 10 nm to 20 nm. However, the present disclosure is not limited thereto; the radius 640 of the nano-particle 600 may be adjusted by changing the thickness of the metal wire used to produce the powder and the thickness of graphene coating on the metal wire.

According to the present disclosure, as a metal wire coated with a carbon-based material is subjected to wire explosion in a solution, composite powder particles composed of metal powder particles and a multilayer graphene-coated film formed on a surface thereof may be prepared.

Particularly, when the composite powder particles are prepared according to the present disclosure, a multilayer graphene film is uniformly coated on almost all surfaces of the metal particle cores to prevent oxidation of internal metal particle cores, and since a multilayer graphene film-coated layer has conductivity, the composite powder also exhibits electric conductivity.

In addition, when the composite powder is prepared according to the present disclosure, compared to carbon-coated metal powders prepared by another method, dispersion stability in a solution may be considerably enhanced.

Such multilayer graphene-coated composite powders may be applied as a material for various applied diodes. For example, the composite powder may be applied in various fields such as an electric/electronic electrode material, a material for storing energy, a composite powder additive, a catalyst, an ink, and a paste.

According to the present disclosure, as a metal wire coated with a carbon-based material is subjected to wire explosion in a solution, a composite powder composed of metal particles and a multilayer graphene-coated film coated on a surface thereof can be prepared.

Also, when the composite powder is prepared according to the present disclosure, almost all surfaces of the metal cores are coated with uniform multilayer graphene to prevent oxidation of internal metal particles, and since a multilayer graphene-coated layer has conductivity, the composite powder also exhibits electric conductivity.

In addition, when the composite powder is prepared according to the present disclosure, compared to carbon-coated metal powders prepared by another method, dispersion stability in a solution can be considerably enhanced.

While the disclosure has been shown and described with reference to certain exemplary embodiments thereof, it will be understood by those skilled in the art that various changes in form and details may be made therein without departing from the scope of the disclosure as defined by the appended claims.

What is claimed is:

1. A method of manufacturing composite powder, the method comprising:

coating a metal wire with a carbon-based material; and performing a wire explosion on the metal wire coated with the carbon-based material in a solution.

2. The method according to claim 1, wherein the metal wire is composed of copper, nickel, aluminum, iron, gold, silver, stainless steel, tin, zinc, titanium, tantalum, an alloy thereof, or a mixture thereof.

3. The method according to claim 1, wherein the carbon-based material comprises graphene or graphite.

4. The method according to claim 3, wherein the carbon-based material comprises graphene or graphite with a thickness of 1 to 20 carbon atom layers.

5. The method according to claim 4, wherein the carbon-based material comprises graphene or graphite with a thickness of 1 to 10 carbon atom layers.

6. The method according to claim 4, wherein the coating of the metal wire with the carbon-based material comprises:

synthesizing the graphene on a surface of the metal wire; or transferring the synthesized graphene on the surface of the metal wire.

7. The method according to claim 1, wherein the solution is an organic solution, an inorganic solution, or an organic and inorganic solution mixture.

8. The method according to claim 7, wherein the solution comprises at least one selected from the group consisting of isopropyl alcohol, acetone, ethanol, methanol, a carbon compound solvent, a carbon-containing glycol, glycerine, triethanolamine or methylene chloride, deionized water, distilled water, hydrogen peroxide, a metal compound solvent, and a combination thereof.

9. The method according to claim 1, wherein the metal powder obtained by the wire explosion comprises composite nanoparticles each comprising a metal core coated with a multilayer graphene sheet having a thickness of approximately 1 to 20 carbon atom layers.

10. A composite powder, comprising:

a metal particle coated with a carbon-coated layer, the carbon-coated layer comprising a multilayer graphene film coating a surface of the metal particle and having electric conductivity, wherein the multilayer graphene film having a thickness of 1 to 20 carbon atom layers.

11. The composite powder according to claim 10, wherein the metal particle is composed of copper, nickel, aluminum, iron, gold, silver, stainless steel, tin, zinc, titanium, tantalum, or an alloy or mixture thereof.

12. The composite powder according to claim 10, wherein the carbon-coated layer comprises 10 wt % or less of an amorphous carbon film based on a total weight of the carbon-coated layer.

13. A method of preparing a composition of composite powder, comprising:

obtaining a metal wire coated with a carbon-based material; and performing a wire explosion on the metal wire coated with the carbon-based material in a solution.

14. The method according to claim 13, the solution comprises at least one selected from the group consisting of isopropyl alcohol, acetone, ethanol, methanol, a carbon compound solvent, a carbon-containing glycol, glycerine, triethanolamine or methylene chloride, deionized water, distilled water, hydrogen peroxide, a metal compound solvent, and a combination thereof.

15. The method according to claim 13, wherein the performing of the wire explosion comprises forming a plasma in the solution, and causing a condensation of nanoparticles comprising a metal core covered with a carbon-coated layer.

16. The method according to claim 13, wherein the metal wire coated with the carbon-based material is obtained by forming a film comprising 2 to 5 layers of graphene sheets over the metal wire.

17. The method according to claim 15, wherein the carbon-coated layer comprising a multilayer graphene film having a thickness of 1 to 20 graphene sheets.

* * * * *